US005679071A

United States Patent [19]

Proctor

[11] Patent Number: 5,679,071

[45] Date of Patent: Oct. 21, 1997

[54] PAINT SPRAY BOOTH PLENUM MODULE

[75] Inventor: Robert D. Proctor, Troy, Mich.

[73] Assignee: ABB Flexible Automation Inc., New Berlin, Wis.

[21] Appl. No.: 488,583

[22] Filed: Jun. 8, 1995

[51] Int. Cl.[6] ..... B05B 15/12

[52] U.S. Cl. ..... 454/52; 454/50; 454/51

[58] Field of Search ..... 454/52, 51, 50

[56] References Cited

U.S. PATENT DOCUMENTS 4,548,579 10/1985 Cunningham ..... 432/72
5,178,679 1/1993 Josefsson .

FOREIGN PATENT DOCUMENTS 668645 12/1938 Germany ..... 454/52

*Primary Examiner*—Henry Bennett
*Assistant Examiner*—Derek S. Boles
*Attorney, Agent, or Firm*—Harness, Dickey & Pierce, P.L.C.

[57] ABSTRACT

A plenum for a paint spray booth including at least one improved plenum module having a pair of side walls and a pair of end walls each comprised of a truss adapted to cooperate with a plurality of stilts thereby independently supporting the plenum above the paint application zone of a paint spray booth. The improved plenum module permits the spacing between plenum stilts to be increased to at least sixty feet thereby decreasing construction costs, increasing the uniformity of airflow from the plenum and decreasing the potential for air leaks from and into the plenum. The improved plenum modules are adapted to be coupled in series and in parallel to provide plenum modules of varying lengths and widths.

14 Claims, 4 Drawing Sheets

PAINT SPRAY BOOTH PLENUM MODULE

BACKGROUND OF THE INVENTION

The invention generally relates to paint spray booths. More particularly, the invention concerns a spray booth air supply plenum supported independently of and above the spray booth application area and adapted to increase the distance between plenum support members thereby increasing the uniformity of airflow into the spray booth application area, reducing the risk of air leaks and improving the ease of constructing the plenum and of installing apparatus within or outside the spray booth.

Typically, paint spray booths include an air supply plenum disposed above a paint application zone. The plenum is intended to provide a substantially uniform airflow into the paint application zone so as to maximize the paint transfer efficiency of the booth. In traditional paint spray booths, a plenum is supported above the paint application zone by support columns associated with the wall panels of the paint application zone. Therefore, erection of the columns and the wall panels must be completed before the plenum modules may be set in place. The structure of prior art plenum modules require that the support columns be distributed throughout the paint application zone walls at 10 to 14 foot centers causing difficulties relating to the installation of paint spray equipment within the paint application zone and effectively prohibiting installation of certain types of equipment outside the application chamber.

The invention disclosed herein provides an improved plenum module structure whereby each plenum module has the structural strength to span support column separations up to and beyond current shipping limits of 60 feet. Further, the improved plenum allows plenum modules to be disposed in a side-by-side arrangement to form a plenum assembly having widths in excess of 40 feet. Plenum support columns or stilts are erected independent of the construction of the paint application zone wall. The improved plenum is attached to the stilts and is independently supported thereby, thus permitting the plenum to be constructed before any of the paint application zone equipment is installed. Installation of the paint application zone equipment after the plenum is erected is performed through the 60 foot spacing between plenum stilts.

The unique advantages resulting from the improved plenum disclosed herein include reducing airflow turbulence caused by plenum support members, reducing the risk of air leaks by decreasing the total effective length of module joints, permitting greater access to the paint application zone for installation and maintenance of equipment and allowing installation of paint application equipment either inside or outside the paint application area. Improved access also decreases construction costs related to the installation of large and cumbersome paint spray zone equipment. Additionally, in certain instances where it is desirable for application equipment to be installed exterior to the paint application zone walls this invention permits the equipment to traverse the entire length of the application zone without interference from the plenum support structure.

SUMMARY OF THE INVENTION

The invention provides an improved plenum associated with a spray booth paint application zone. The structure of the improved plenum modules allow the plenum to be supported independent of the paint spray booth walls. The paint spray booth is comprised of a booth tank, a paint application zone and a plenum having at least one plenum module supported by a plurality of stilts. The stilts provide the structural support for the improved plenum arrangement and transfer the load from the plenum to either the booth tank support columns or the surrounding booth support surface.

The present invention is directed to an improved plenum structure wherein each plenum module includes side walls and end walls either consisting of supporting truss members or having truss members formed integrally therewith. This arrangement increases the maximum spacing between plenum support columns or stilts over that used in prior art plenums. The use of trusses in the plenum wall structure also improves the structural integrity of individual plenum modules and the plenum assembly as a whole. Increasing the spacing between stilts also decreases the turbulence in the airflow into the paint application zone caused by the columns and plenum module joints.

It is a feature of this invention that the improved plenum is structurally independent from the paint spray booth walls and that the plenum may therefore be installed prior to the erection of the booth walls.

It is a further feature of this invention that the plenum truss structure permits a stilt spacing of, for example, 60 feet.

It is an additional feature of this invention that the plenum may include plenum modules disposed in a side-by-side arrangement without requiring the use of a center support column at the intersection of the plenum modules.

It is another feature of this invention that increased plenum lengths require the construction of fewer joints between adjacent plenum modules thereby decreasing the potential for air leaks from and into the plenum.

It is also a feature of this invention that the uniformity of airflow from the plenum into the paint application zone is improved as a result of decreasing the number of plenum support columns and plenum module joints which cause eddies or otherwise increase the turbulence of the airflow.

BRIEF DESCRIPTION OF THE DRAWINGS

The objects and features of the invention will become apparent from a reading of a detailed description taken in conjunction with the drawings, in which.

DETAILED DESCRIPTION OF THE PREFERRED EMBODIMENT

Figure 1:
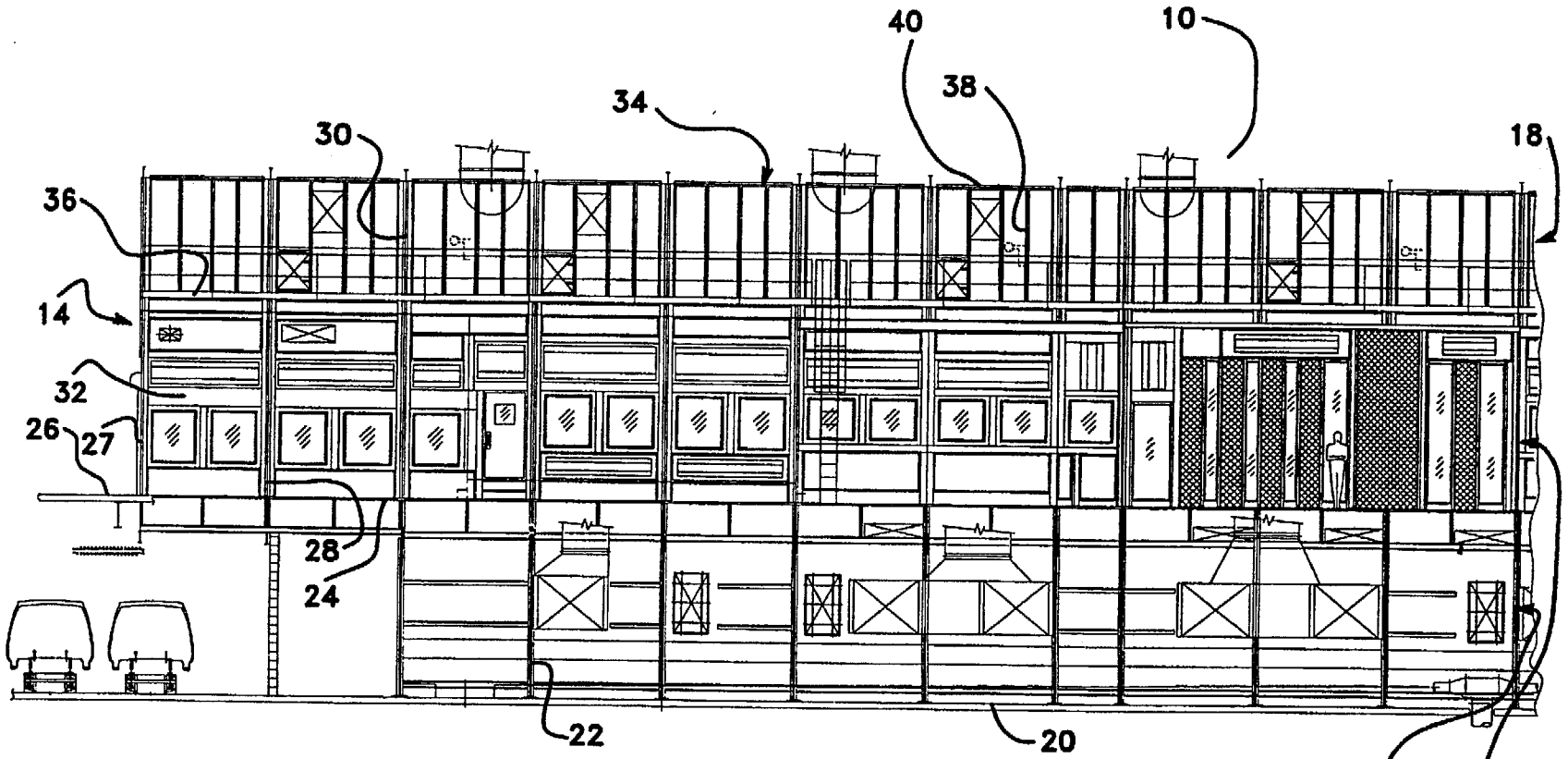
Fig-1 PRIOR ART
FIG. 1 is a longitudinal side view of a prior art paint spray booth including a booth tank, paint application area and plenum.

Referring now to FIG. 1 of the drawings, a commonly used prior art paint spray booth 10 is comprised of a booth tank 12 and a booth area 14. Booth area 14 includes a paint application area 16 and an air supply plenum 18.

Booth tank 12 includes a service pit slab 20 commonly formed of concrete cast in place on a booth support surface.

A plurality of foundation columns 22 extend vertically from service pit slab 20 and are connected thereto by a plurality of bolts or other suitable fasteners (not shown). Foundation columns 22 support and distribute the load from booth 14 to service pit slab 20. Floor grating 24 forms the floor of paint application zone 16, connects columns 22 and allows paint overspray from paint application zone 16 to pass into booth tank 12. Operating floor 26 is located at substantially the same elevation as floor grating 24 and extends beyond exterior walls 27 of booth 14.

A plurality of booth columns 28 extend vertically from floor grating 24 and are generally supported by foundation columns 22. Booth columns 28 support a plurality of booth wall panels 32 which form the exterior side walls of booth 14 in paint application zone 16. By interconnecting adjacent booth columns 28, booth wall panels 32 increase the stability and load carrying capacity of booth columns 28.

Plenum 18 includes a plurality of plenum modules 34 connected to plenum columns 30 which are supported by booth columns 28 and foundation columns 22. Plenum 18 and paint application zone 16 are separated by filter ceiling 36 through which air flows from plenum modules 34 into paint application zone 16 as described, for example, in U.S. Pat. No. 5,178,679, assigned to the assignee of this application and incorporated herein by reference. In prior art plenum modules such as is shown in FIG. 1, each plenum module 34 includes side walls having vertically disposed support members 38 connected to top members 40. As a result of the load carrying capacity of this structure, the length of each plenum module 34 is commonly limited to 10 to 14 feet. The limited length of plenum modules 34 correspondingly limits the spacing of plenum columns 30 and booth columns 28. Moreover, because plenum modules 34 are supported by booth columns 28 and booth wall panels 32, plenum modules 34 cannot be installed in paint spray booth 10 until booth columns 28 and booth wall panels 32 have been erected.

The column spacing and construction sequence limitations resulting from limited plenum module lengths create several construction difficulties. Most notably, the 10 to 14 foot maximum spacing between booth columns 28 makes placing equipment in the paint application zone difficult and expensive. Large equipment or material which cannot fit through the column openings may be placed on floor grating 24 prior to erection of booth columns 28. However, this increases the probability that the equipment may be damaged as a result of column erection, construction of booth wall panels 32 or installation of plenum modules 34.

A further deficiency present in prior art plenums relates to the common use of a traversing "X-Rail" robot to apply paint in the paint application zone. An "X-Rail" robot commonly consists of a body portion and an extension arm to which a paint application nozzle is attached. It is preferred that the body portion of the "X-Rail" robot be mounted on a rail located externally of the paint application zone so that the robot is not exposed to paint particles. In the preferred arrangement, the robot's extension arm projects the paint application nozzle into the paint application zone while the robot body traverses externally thereof. However, the limited column spacing in prior art paint spray booths does not allow an "X-Rail" robot to traverse exterior of booth wall panels 32 for more than 10 to 14 feet. Therefore, in prior art paint spray booths, the robot is generally mounted within the paint application zone.

The limited spacing of booth columns 28 in prior art paint spray booths 10 also adversely affects the uniformity of the airflow from plenum modules 34 to paint application area 16. Adjacent plenum modules 34 abut to form a joint supported by a booth column 28. The joint and corresponding column create a discontinuity in the plenum module which cause eddies and otherwise increases the turbulence in paint application area 16. The increase in turbulence is most notable in the area proximate to filter ceiling 36. Non-uniformity in the down draft airflow from plenum modules 34 into paint application area 16 creates undesirable variations in the thickness of the applied paint layer and paint overspray as described in U.S. Pat. No. 5,178,679 and may circulate foreign particulate matter present in paint application area 16.

Figure 2:
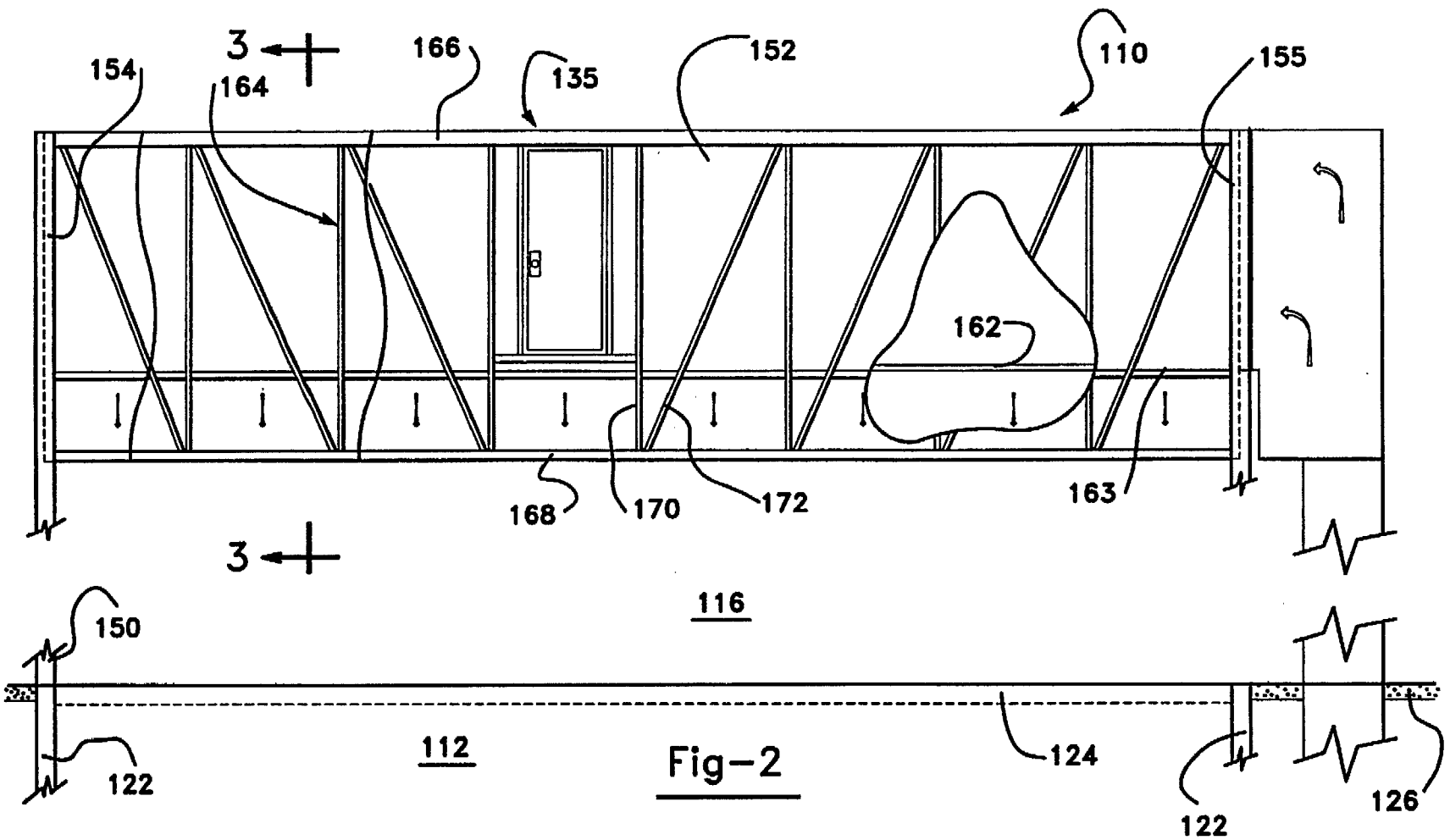
FIG. 2 is a longitudinal side view of an improved plenum module including plenum support stilts.
Figure 3:
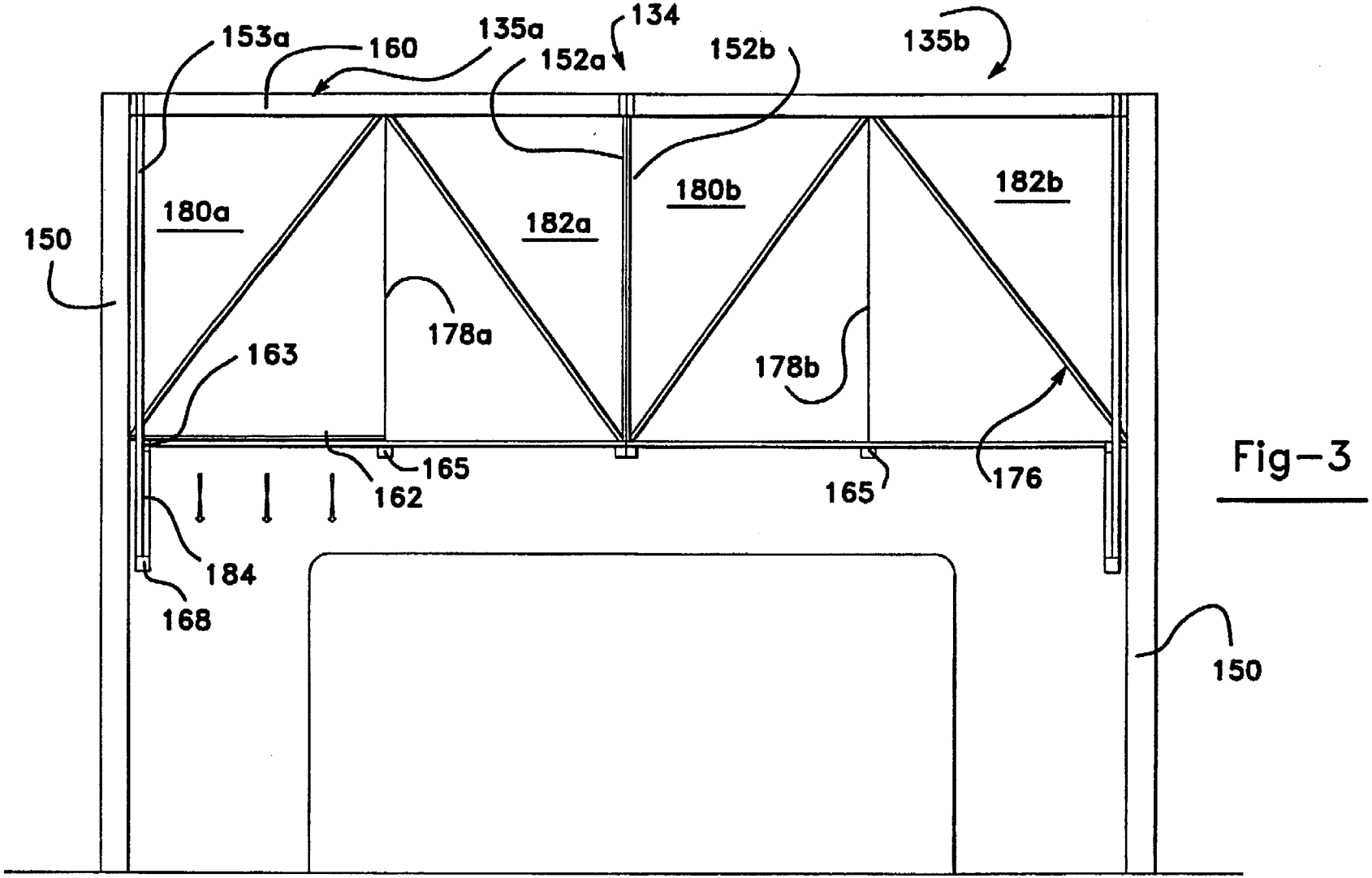
FIG. 3 is an end view of the plenum shown in FIG. 2.

The invention disclosed herein and shown in FIG. 2 and FIG. 3, eliminates the aforementioned difficulties through the use of plenum modules having lengths in excess of 60 feet which are supported solely by a plurality of stilts bearing on foundation columns 122 or other suitable surface. The 60 feet column spacing allows paint application equipment and other material to be placed within the paint application zone after construction of the plenum and its support columns, allows an externally mounted "X-Rail" robot to traverse the length of the column spacing without obstruction and decreases the turbulence of airflow into the paint application area.

With reference to FIG. 2, the subterranean structure of the improved paint spray booth is substantially the same as that of the prior art booth and similar numerical designations are therefore used. Foundation columns 122 extend vertically from the service pit slab (not shown) to support floor grating 124 and operating floor 126.

Figure 4:
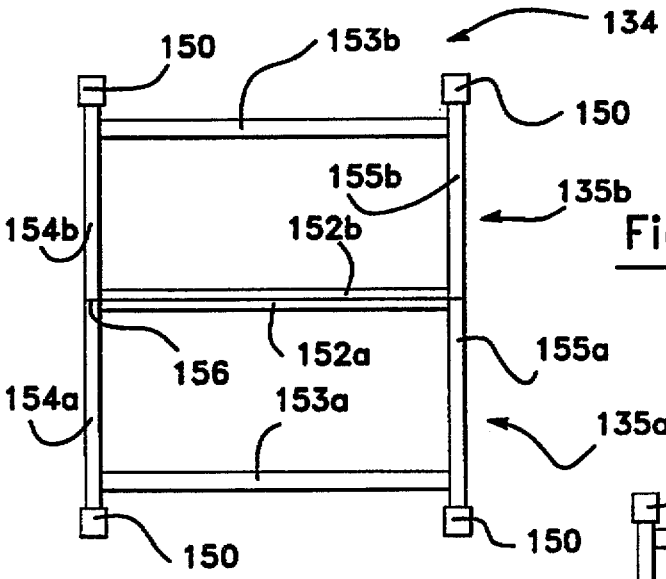
FIG. 4 is a perspective view of the plenum shown in FIGS. 2 and 3.

FIG. 4 shows an improved plenum assembly 134 including a pair of substantially identical plenum modules **135*a* and 135*b* supported by a plurality of stilts 150. Plenum modules 135*a*, 135*b* include a plurality of substantially identical members referenced in the drawings by substantially identical alphanumeric characters. For example, first plenum module 135*a* includes a first side wall 152*a* whereas second plenum module 135*b* includes a first side wall 152*b*. The remaining members of first plenum module 135*a* include second side wall 153*a*, first end member 154*a* and second end member 155*a*. Each plenum module 135 further includes a solid top member 160 and a permeable floor member 162 connected to side walls 152 by floor support members 163. As is known, in order to increase the uniformity of air flow through permeable floor member 162** and intercept any foreign matter, a filter media (not shown) is commonly coupled thereto or disposed thereon.

In the preferred embodiment shown in FIG. 4, first and second side walls, **152*a*, 152*b*, 153*a* and 153*b* are connected to first and second end walls 154*a*, 154*b*, 155*a* and 155*b* thereby forming plenum module 135 as it generally exists when shipped by the manufacturer. Due to shipping constraints, the width of a plenum module generally cannot exceed 14 feet and its length is generally limited to 60 feet. In accordance with these shipping constraints, the plenum assembly shown in FIGS. 3 and 4** has a maximum width of 28 feet and a maximum length of 60 feet. It will be apparent to one skilled in the art, however, that the present invention may be modified or adapted to provide plenum modules of much greater width and length.

In the preferred embodiment as shown in FIG. 2, side walls 152 and 153 each consist solely of a truss 164 having a top member 166, a bottom member 168 and a plurality of vertical members 170 and diagonal members 172 connecting top member 166 to bottom member 168. Truss 164 is connected to end walls 154 and 155 by welding or other appropriate method known in the art. Preferably, truss members 166, 168, 170 and 172 are comprised of mild or stainless steel tube having a predetermined wall thickness. The preferred tube is rectangular in cross-section with six (6) inch by four (4) inch sides. It will be appreciated by those skilled in the art that other material, dimensions and configurations may be used.

Referring now to FIG. 3, each plenum module end wall 154*a*, 154*b*, 155*a* and 155*b* includes a truss 176 formed integrally therewith and having a configuration and load bearing characteristic similar to that of truss 164. It will be apparent to one skilled in the art that trusses 164 and 176 may either be formed integrally with side walls 152, 153 and end walls 154 and 155, respectively, or the plenum module side and end walls may consist solely of trusses 164 and 176. Plenum modules 135*a* and 135*b* are preferably constructed by the manufacturer and shipped as a single unit comprised of top member 160, floor member 162, side walls 152, 153 and end walls 154, 155. Construction of the module by the manufacturer allows a maximum of joints to be seam welded thereby decreasing the potential for air leaks.

As best seen in FIG. 4, plenum assembly 134 is constructed by first erecting stilts 150. Plenum modules 135*a*, 135*b* are then raised into position, end members 154*a*, 154*b*, 155*a* and 155*b* are connected to stilts 150 and end members 154*a*, 155*a* and side wall 152*a* of first plenum module 135*a* are connected to end members 154*b*, 155*b* and side wall 152*b*, of second plenum module 135*b*, respectively. Joint 156, extending from and through end member 154 to and from end member 155, must be sealed to prevent air passage therethrough. It is preferred that the aforementioned connections be made by welding or other appropriate technique known in the art.

Figure 5:
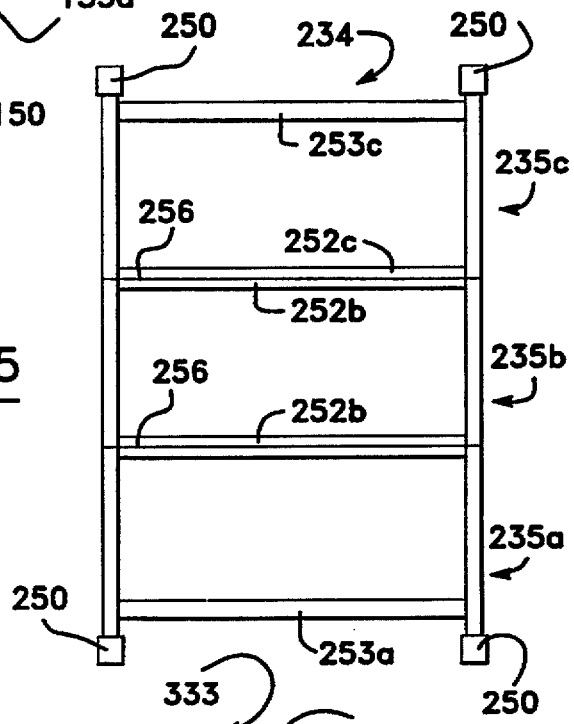
FIG. 5 is a perspective view of a plurality of plenum modules disposed in a preferred embodiment of the invention.

As shown in FIG. 5, more than two improved plenum modules may be disposed in a side by side arrangement to provide a plenum assembly having a width greater than 28 feet. Plenum apparatus 234 illustrates the preferred embodiment of the invention in that plenum assemblies are commonly less than 60 feet in length and up to approximately 40 feet in width. Plenum modules 235*a*, 235*b*, 235*c* are connected as shown in FIG. 5 to provide a plenum apparatus having a 40 foot width. Plenum module 235*b* includes a pair of side walls 252*b* connected to side walls 252*a*, 252*c* of plenum modules 235*a* and 235*c*, respectively. Again, joints 256 must be sealed by sealing material known in the art.

Figure 6:
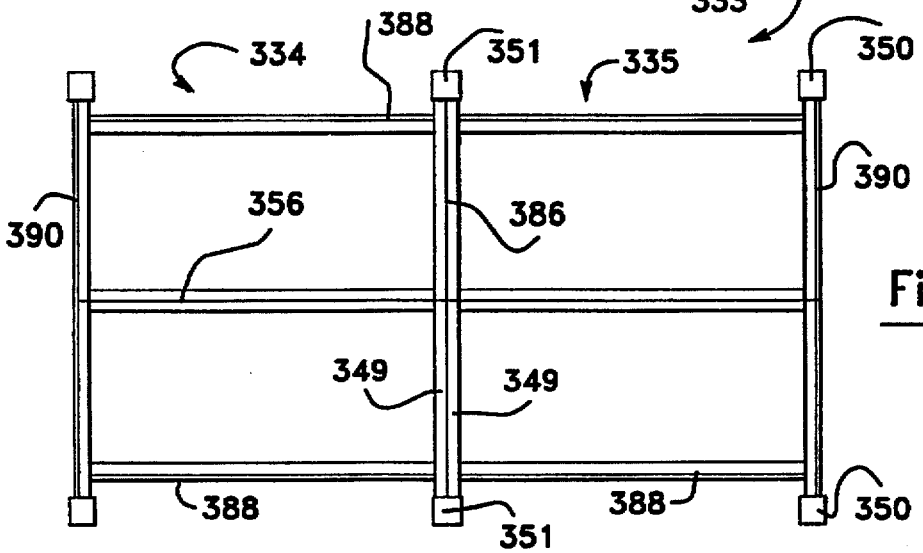
FIG. 6 is a perspective view of a plenum comprised of multiple plenum modules arranged both in series and in parallel.

As best seen in FIG. 6, improved plenum assembly 333 may include a first pair of plenum modules 334 and a second pair of plenum modules 335 connected in series and forming transverse joint 386. Such an arrangement permits the length of plenum arrangement 333 to exceed 60 feet. Intermediate stilts 351 are provided to support intermediate walls 349. Intermediate walls 349 each include or consist solely of trusses and are similar in design and arrangement to end walls 154 having trusses 176 as shown in FIGS. 3 and 4. Again, transverse joint 386 must be sealed using sealing material known in the art.

As will be appreciated by those skilled in the art, solid side walls 388 and solid end walls 390 may be attached to the exterior surfaces of plenum assembly 133. Solid walls 388, 390 act to isolate the airflow in the plenum assembly from the surrounding environment. Similar walls are generally provided for the plenum assemblies shown in FIGS. 2–5.

As disclosed to this point, the invention is comprised of a free standing plenum 133 supported by a plurality of stilts 150. This plenum structure provides advantages over prior art paint spray booth arrangements in that the spacing between stilts 150 can meet and exceed 60 feet thereby providing sufficient space for movement and installation of equipment into the paint spray area located between plenum 133 and booth tank 112 (FIG. 2).

Further, increasing the length of the plenum module correspondingly decreases the number and length of joints 356, 386 (FIG. 6) between adjacent modules as compared to prior art plenums. The joint formed by adjoining plenum modules creates a potential for air leaks both at the joint itself and at the edge length of the filter media adjacent thereto. Air leaks through the plenum can cause volatile organic compounds to be released into the plant atmosphere. Such releases are especially troublesome in spray booths using air recirculation technology. Decreasing the joint lengths in the plenum reduces the amount and cost of air seal material used and, most importantly, provides a plenum which is safer and more efficient to operate. Reducing the edge length of the filter media also substantially reduces the potential for damage to the painted products resulting from dirt bypassing the filter media. As the improved plenum module disclosed herein has a maximum length significantly greater than the 10 to 14 foot length of prior art plenums, this invention significantly decreases joint lengths present in the plenum assembly.

FIG. 3 illustrates an additional improvement provided by the present invention wherein plenum modules 135*a* and 135*b* include fire protection piping such as duct 165 formed integrally therewith or connected thereto. Ducts 165 are supported by vertical members 178*a* and 178*b* which may consist of a sheet member interconnecting top member 160 to filter ceiling 162 thereby forming a partition wall creating first and second chambers 180*a*, 182*a* in first plenum module 135*a* and first and second chambers 180*b*, 182*b* in second plenum module 135*b*. Alternatively, vertical members 178*a* and 178*b* may consist solely of rods, thin pieces of sheet metal or other members whose size and spacing are adequate to support duct 165 while having a minimal effect on the uniformity of airflow through plenum modules 135*a* and 135*b*. Incorporating the fire protection piping as part of the plenum module prior to shipment decreases the labor cost of erecting the modules and increases airflow uniformity by moving the piping to the exterior of the plenum.

With reference to FIGS. 2 and 3, side wall truss 164 extends vertically below permeable floor member 162 providing a structure to which window and door framing may be connected to provide a plurality of windows and doors substantially similar to those shown in the prior art booth of FIG. 1. Moreover, the booth walls which define the paint application area may be formed integrally with plenum side truss 164 or connected thereto permitting the plenum and booth construction to be completed simply by erecting the plenum. Truss 164 includes a plurality of vertical members 184 extending upwardly from bottom member 168 to support permeable floor member 162. Vertical members 184 cooperate with bottom member 168 and other truss members to support the window and door framing as previously mentioned.

While specific embodiments of the unique plenum for paint spray booths disclosed herein have been shown and described in detail, it will be appreciated by those skilled in the art that the present invention may be embodied in other forms without departing from the principles and fair scope of the present invention.

Various other advantages and modifications will become apparent to one skilled in the art after having the benefit of studying the teachings of the specification, the drawings and the following claims.

What is claimed is:

1. In a paint spray booth having a plurality of booth walls and including a support apparatus and a plenum, said plenum comprising:

a plurality of stilts extending from said support apparatus; and at least one first plenum module including a top member, a floor member, at least two end members each including a truss and at least two side walls each including a truss, each of said at least two end members coupled to said top member, floor member and said at least two side walls, said at least one plenum module coupled to said stilts whereby said at least one first plenum module is supported independently of the booth walls by said plurality of stilts.

2. The plenum of claim 1 wherein said plurality of stilts include at least four stilts.

3. The plenum of claim 2 wherein said at least two end members further include a first end member and a second end member each having first and second ends, wherein said at least two side walls further include a first side wall and a second side wall each having first and second ends and wherein said top member and said floor member are coupled to said first and second side walls, said first ends of said first and second side walls coupled to said first end member defining a first end of said at least one first plenum module, said second ends of said first and second side walls coupled to said second end member defining a second end of each of said at least one first plenum modules, each of said first and second end members coupled to at least one of said at least four stilts proximate to said first side wall.

4. The plenum of claim 3 further including at least one second plenum module including a top member, a floor member, first and second end members and first and second side walls, said first and second end members and said first and second side walls each including a truss and first and second ends, said top member and said floor member coupled to said first and second side walls, said first ends of said first and second side walls coupled to said first end member defining a first end of said at least one second plenum module, said second ends of said first and second side walls coupled to said second end member defining a second end of each of said at least one second plenum modules, each of said first and second end members coupled to at least one of said at least four stilts proximate to said first side walls and said second side wall of said at least one first plenum module coupled to said second side wall of said at least one second plenum module.

5. The plenum of claim 4 wherein each of said trusses associated with each of said first and second side walls extend vertically below said floor member.

6. The plenum of claim 4 wherein said at least one first plenum module further includes a partition wall having a first end coupled to said top member and a second end coupled to said floor member whereby said at least one first plenum module includes a plurality of plenum chambers.

7. The plenum of claim 6 wherein said at least one second plenum module further includes a partition wall having a first end coupled to said top member and a second end coupled to said floor member whereby said at least one second plenum module includes a plurality of plenum chambers.

8. The plenum of claim 4 wherein the second end of one of said at least one first plenum modules is coupled to the first end of another of said at least one first plenum modules and wherein the second end of one of said at least one second plenum modules is coupled to the first end of another of said at least one second plenum modules.

9. In a paint spray booth including a plenum support apparatus and a plenum, said plenum comprising:

at least four stilts extending from said plenum support apparatus;

at least one first plenum module including a top member, a floor member, first and second end members and first and second side walls, said first and second end members and said first and second side walls each including a truss and first and second ends, said top member and said floor member coupled to said first and second side walls, said first ends of said first and second side walls coupled to said first end member defining a first end of said at least one first plenum module, said second ends of said first and second side walls coupled to said second end member defining a second end of each of said at least one first plenum modules, each of said first and second end members coupled to at least one of said at least four stilts proximate to said first side wall;

at least one second plenum module including a top member, a floor member, first and second end members and first and second side walls, said first and second end members and said first and second side walls each including a truss and first and second ends, said top member and said floor member coupled to said first and second side walls, said first ends of said first and second side walls coupled to said first end member defining a first end of said at least one second plenum module, said second ends of said first and second side walls coupled to said second end member defining a second end of each of said at least one second plenum modules, each of said first and second end members coupled to at least one of said at least four stilts proximate to said first side walls; and at least one third plenum module including a top member, a floor member first and second end members and first and second side walls, said first and second side walls and first and second end members each including a truss and first and second ends, said top member and said floor member coupled to said first and second side walls, said first ends of said first and second side walls coupled to said first end member defining a first end of said at least one third plenum module, said second ends of said first and second side walls coupled to said second end member defining a second end of each of said at least one third plenum module, one of said first and second side walls of said at least one third plenum module coupled to said second side wall of one of said at least one first plenum module and said at least one second plenum module, another of said first and second side walls of said at least one third plenum module coupled to said second side wall of another of said at least one first plenum module and said at least one second plenum module.

10. The plenum of claim 9 wherein each of said trusses associated with each of said first and second side walls extend vertically below said floor member.

11. The plenum of claim 9 wherein said at least one first plenum module further includes a partition wall having a first end coupled to said top member and a second end coupled to said floor member whereby said at least one first plenum module includes a plurality of plenum chambers.

12. The plenum of claim 11 wherein said at least one second plenum module further includes a partition wall having a first end coupled to said top member and a second end coupled to said floor member whereby said at least one second plenum module includes a plurality of plenum chambers.

13. The plenum of claim 12 wherein said at least one third plenum module further includes a partition wall having a first end coupled to said top member and a second end coupled to said floor member whereby said at least one third plenum module includes a plurality of plenum chambers.

14. The plenum of claim 13 wherein said second end of one of said at least one first plenum modules is coupled to said first end of another of said at least one first plenum modules, said second end of one of said at least one second plenum modules coupled to said first end of another of said at least one second plenum modules and said second end of one of said at least one third plenum modules coupled to said first end of another of said at least one third plenum modules.

* * * * *